US011460047B2

(12) United States Patent
Sakisaka et al.

(10) Patent No.: US 11,460,047 B2
(45) Date of Patent: Oct. 4, 2022

(54) THROTTLE MECHANISM FOR CENTRIFUGAL COMPRESSOR AND TURBOCHARGER

(71) Applicant: IHI Corporation, Tokyo (JP)

(72) Inventors: Ryota Sakisaka, Tokyo (JP); Takashi Fujiwara, Tokyo (JP); Atsushi Yonemura, Tokyo (JP); Wataru Ueda, Tokyo (JP); Hiroshi Saito, Tokyo (JP); Yusei Yokoyama, Tokyo (JP); Takahiro Bamba, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/116,188

(22) Filed: Dec. 9, 2020

(65) Prior Publication Data

US 2021/0088054 A1 Mar. 25, 2021

Related U.S. Application Data

(63) Continuation of application No. PCT/JP2019/023892, filed on Jun. 17, 2019.

(30) Foreign Application Priority Data

Aug. 7, 2018 (JP) ..... JP2018-148480

(51) Int. Cl.
*F04D 29/46* (2006.01)
*F04D 17/10* (2006.01)
(Continued)

(52) U.S. Cl.
CPC ..... *F04D 29/462* (2013.01); *F02B 33/40* (2013.01); *F04D 17/10* (2013.01);
(Continued)

(58) Field of Classification Search
CPC . F04D 29/464; F04D 27/0253; F05D 2250/51
See application file for complete search history.

(56) References Cited

U.S. PATENT DOCUMENTS 4,122,668 A 10/1978 Chou et al.
2017/0298943 A1 10/2017 Mohtar et al.
(Continued)

FOREIGN PATENT DOCUMENTS

CN 2002-256675 A 9/2002
CN 202251067 U 5/2012
(Continued)

OTHER PUBLICATIONS

International Search Report dated Sep. 3, 2019 in PCT/JP2019/023892 filed on Jun. 17, 2019 (with English Translation), 2 pages.
(Continued)

*Primary Examiner* — J. Todd Newton
(74) *Attorney, Agent, or Firm* — Oblon, McClelland, Maier & Neustadt, L.L.P.

(57) ABSTRACT

A centrifugal compressor includes: a compressor housing in which an intake passage is formed; a compressor impeller provided in the intake passage; an actuator that causes a rod to linearly move in a direction intersecting with a rotation axis direction of the compressor impeller; a connection member connected to the rod; a throttle member including a protruding portion; a connection shaft extending in the rotation axis direction and connecting the connection member and the throttle member; and a rotation shaft extending in a direction parallel to the connection shaft and serving as a rotation center of the throttle member.

9 Claims, 8 Drawing Sheets

(51) Int. Cl.
*F04D 29/42* (2006.01)
*F02B 33/40* (2006.01)

(52) U.S. Cl.
CPC ..... *F04D 29/4213* (2013.01); *F05D 2220/40* (2013.01); *F05D 2250/512* (2013.01)

(56) References Cited

U.S. PATENT DOCUMENTS

| | | | | |
|---|---|---|---|---|
| 2017/0298953 | A1 | 10/2017 | Lombard et al. | |
| 2019/0048876 | A1* | 2/2019 | Mohtar | F04D 29/685 |
| 2019/0136755 | A1* | 5/2019 | Lombard | F02B 37/225 |
| 2019/0264604 | A1* | 8/2019 | Lombard | F04D 29/4206 |
| 2019/0264710 | A1* | 8/2019 | Mohtar | F04D 29/667 |
| 2019/0271329 | A1* | 9/2019 | Mohtar | F04D 29/462 |

FOREIGN PATENT DOCUMENTS

| | | | |
|---|---|---|---|
| CN | 1044208898 | A | 3/2015 |
| CN | 104781519 | A | 7/2015 |
| CN | 104968944 | A | 10/2015 |
| CN | 107035722 | A | 8/2017 |
| CN | 107304709 | A | 10/2017 |
| DE | 10 2014 225 716 | A1 | 7/2015 |
| DE | 10 2016 200 891 | A1 | 7/2017 |
| JP | 5-256149 | A | 10/1993 |
| JP | 11-303798 | A | 11/1999 |
| JP | 2009-236035 | A | 10/2009 |
| JP | 2010-209867 | A | 9/2010 |
| JP | 2016-094840 | A | 5/2016 |
| JP | 2016-173051 | A | 9/2016 |
| KR | 10-2006-0046675 | A | 5/2006 |

OTHER PUBLICATIONS

Combined Chinese Office Action and Search Report dated Dec. 3, 2021 in Chinese Patent Application No. 201980039440.9 (with English translation of Categories of Cited Documents), 8 pages.
Notice of Allowance and Registration dated Aug. 3, 2022 issued in corresponding Chinese patent application No. 201980039440.9.

* cited by examiner

THROTTLE MECHANISM FOR CENTRIFUGAL COMPRESSOR AND TURBOCHARGER

CROSS REFERENCE TO RELATED APPLICATIONS

This application is a continuation application of International Application No. PCT/JP2019/023892, filed on Jun. 17, 2019, which claims priority to Japanese Patent Application No. 2018-148480 filed on Aug. 7, 2018, the entire contents of which are incorporated by reference herein.

BACKGROUND ART

Technical Field

The present disclosure relates to centrifugal compressors and turbochargers.

Related Art

Conventionally, a centrifugal compressor is included in a turbocharger. For example, in the turbocharger described in Patent Literature 1, an intake passage is formed upstream of the compressor impeller. In the intake passage, throttle members are provided on an outer side in the radial direction of the compressor impeller. A plurality of throttle members is arranged side by side in the circumferential direction of the compressor impeller. An arm portion is included in the throttle member. The arm portion extends in the rotation axis direction of the compressor impeller. The arm portion is inserted through an engaging portion of a drive ring and a slit hole of a ring plate.

The engaging portion extends in the radial direction of the compressor impeller. The slit hole is inclined with respect to the radial direction of the compressor impeller. When the drive ring is driven, the arm portion is pressed against the engaging portion and an inner wall of the slit hole. When the arm portion is pressed, a part of the throttle members projects inside the intake passage. In this manner, the flow passage cross-sectional area of the intake passage is reduced.

CITATION LIST

Patent Literature

Patent Literature 1: JP 2016-173051 A

SUMMARY

Technical Problem

As described in Patent Literature 1, the mechanism for changing the flow passage cross-sectional area of an intake passage is complicated. Therefore, development of technology for simplifying the structure is desired.

An object of the present disclosure is to provide a centrifugal compressor and a turbocharger a structure of which can be simplified.

Solution to Problem

In order to solve the above problem, a centrifugal compressor according to an aspect of the present disclosure includes: a compressor housing in which an intake passage is formed; a compressor impeller provided in the intake passage; an actuator that causes a rod to linearly move in a direction intersecting with a rotation axis direction of the compressor impeller; a connection member connected to the rod; a throttle member including a protruding portion; a connection shaft extending in the rotation axis direction and connecting the connection member and the throttle member; and a rotation shaft extending in a direction parallel to the connection shaft and serving as a rotation center of the throttle member.

The throttle member may be switched between a throttle position, at which the protruding portion protrudes into the intake passage, and a retracted position, at which the protruding portion is positioned on an outer side in a radial direction of the compressor impeller with respect to the throttle position, depending on a rotation angle with the rotation shaft as a rotation center.

The throttle member may include a first throttle member and a second throttle member, and the connection shaft and the rotation shaft may be provided to each of the first throttle member and the second throttle member.

The compressor housing, the connection member, the first throttle member, and the second throttle member may be included in a four-link mechanism.

Both ends of protruding portions of both the first throttle member and the second throttle member may be in contact with each other and form an annular hole having an inner diameter smaller than that of the intake passage.

A rotation center of the compressor impeller may be positioned in a middle of the two rotation shafts provided to the first throttle member and the second throttle member.

The rotation shaft may connect the throttle member and a wall surface of the compressor housing facing the throttle member in the rotation axis direction, and may be restricted from movement in a planar direction orthogonal to the rotation axis direction, and the connection shaft may be provided so as to be movable in the planar direction orthogonal to the rotation axis direction.

The connection member may be provided with a rod connection portion connected to the rod at a position outer side in a radial direction of the compressor impeller with respect to the intake passage and farther from the rotation shaft than the connection shaft.

A tapered portion may be formed in the protruding portion on a side opposite to a counterpart surface facing the compressor impeller, the tapered portion having a distance to the counterpart surface that decreases as closer to an inner side in a radial direction of the compressor impeller.

In order to solve the above problem, a turbocharger according to an aspect of the present disclosure includes the centrifugal compressor described above.

Effects of Disclosure

According to the present disclosure, it is possible to simplify the structure.

DESCRIPTION OF EMBODIMENTS

An embodiment of the present disclosure will be described in detail below with reference to the accompanying drawings. Dimensions, materials, specific numerical values, and the like illustrated in embodiments are merely examples for facilitating understanding, and the present disclosure is not limited thereby unless otherwise specified. Note that, in the present specification and the drawings, components having substantially the same function and structure are denoted by the same symbol, and redundant explanations are omitted. Components not directly related to the present disclosure are not illustrated.

Figure 1:
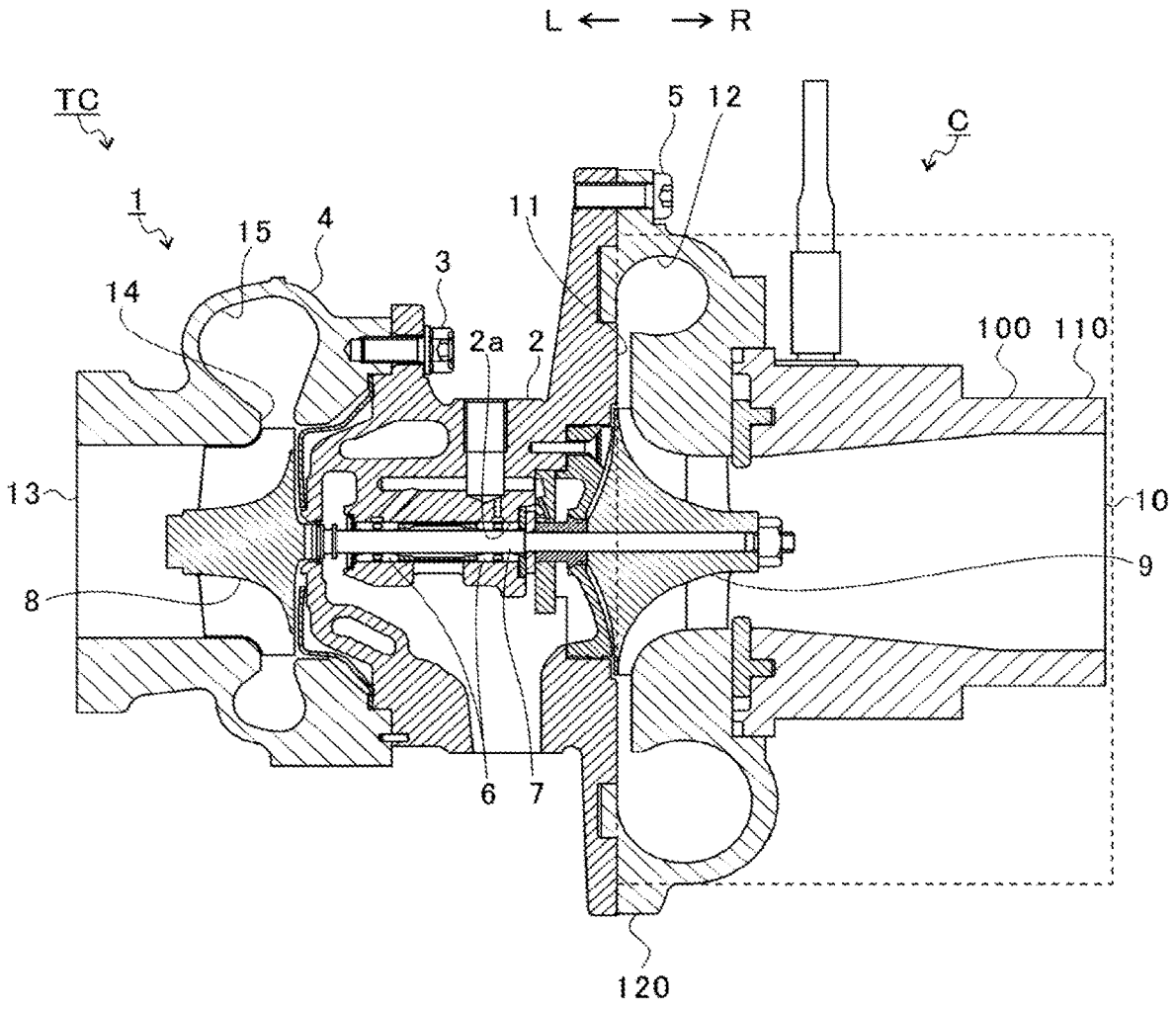
FIG. 1 is a schematic cross-sectional view of a turbocharger.

FIG. 1 is a schematic cross-sectional view of a turbocharger TC. Description is given assuming that a direction of an arrow L illustrated in FIG. 1 is the left side of the turbocharger TC. Description is given assuming that a direction of an arrow R illustrated in FIG. 1 is the right side of the turbocharger TC. As illustrated in FIG. 1, the turbocharger TC includes a turbocharger main body 1. The turbocharger main body 1 includes a bearing housing 2. A turbine housing 4 is connected to the left side of the bearing housing 2 by a fastening bolt 3. A compressor housing 100 is connected to the right side of the bearing housing 2 by a fastening bolt 5.

A receiving hole 2*a* is formed in the bearing housing 2. The receiving hole 2*a* penetrates in the left-right direction of the turbocharger TC. Bearings 6 are provided in the receiving hole 2*a*. In FIG. 1, a full-floating bearing is illustrated as an example of the bearings 6. However, the bearings 6 may be another radial bearing such as a semi-floating bearing or a rolling bearing. A shaft 7 is rotatably supported by the bearings 6. A turbine impeller 8 is provided at the left end of the shaft 7. The turbine impeller 8 is rotatably accommodated in the turbine housing 4. A compressor impeller 9 is provided at the right end of the shaft 7. The compressor impeller 9 is rotatably accommodated in the compressor housing 100. The compressor housing 100 includes a first housing member 110 and a second housing member 120. The first housing member 110 and the second housing member 120 will be described in detail later.

An intake port 10 is formed in the compressor housing 100. The intake port 10 opens to the right side of the turbocharger TC. The intake port 10 is connected to an air cleaner (not illustrated). Furthermore, in a state where the bearing housing 2 and the compressor housing 100 are connected by the fastening bolt 5, a diffuser flow passage 11 is formed. The diffuser flow passage 11 pressurizes the air. The diffuser flow passage 11 is formed in an annular shape from the inner side to the outer side in the radial direction of the shaft 7 (compressor impeller 9) (hereinafter, simply referred to as the radial direction). The diffuser flow passage 11 communicates with the intake port 10 via the compressor impeller 9 on the inner side in the radial direction.

Furthermore, a compressor scroll flow passage 12 is formed inside the compressor housing 100. The compressor scroll flow passage 12 is annular. The compressor scroll flow passage 12 is positioned on the outer side in the radial direction with respect to the compressor impeller 9. The compressor scroll flow passage 12 communicates with an intake port of an engine (not illustrated). The compressor scroll flow passage 12 also communicates with the diffuser flow passage 11. When the compressor impeller 9 rotates, the air is sucked from the intake port 10 into the compressor housing 100. The sucked air is accelerated by the effect of the centrifugal force in the process of flowing through blades of the compressor impeller 9. The accelerated air is pressurized by the diffuser flow passage 11 and the compressor scroll flow passage 12. The pressurized air flows out from a discharge port (not illustrated) and is guided to an intake port of an engine.

As described above, the turbocharger TC includes a centrifugal compressor C (compressor). The centrifugal compressor C includes the compressor housing 100, the compressor impeller 9, and the compressor scroll flow passage 12.

An exhaust port 13 is formed in the turbine housing 4. The exhaust port 13 opens to the left side of the turbocharger TC. The exhaust port 13 is connected to an exhaust gas purification device (not illustrated). The turbine housing 4 includes a flow passage 14 and a turbine scroll flow passage 15. The turbine scroll flow passage 15 is positioned on the outer side in the radial direction with respect to the turbine impeller 8. The flow passage 14 is positioned between the turbine impeller 8 and the turbine scroll flow passage 15.

The turbine scroll flow passage 15 communicates with a gas inlet port (not illustrated). Exhaust gas discharged from an exhaust manifold of the engine (not illustrated) is guided to the gas inlet port. The turbine scroll flow passage 15 also communicates with the flow passage 14. The exhaust gas guided from the gas inlet port to the turbine scroll flow passage 15 is guided to the exhaust port 13 via the flow passage 14 and spaces between blades of the turbine impeller 8. The exhaust gas guided to the exhaust port 13 rotates the turbine impeller 8 in the process of flowing therethrough.

The turning force of the turbine impeller 8 is transmitted to the compressor impeller 9 via the shaft 7. As described above, the turning force of the compressor impeller 9 causes the air to be pressurized and to be guided to the intake port of the engine.

Figure 2:
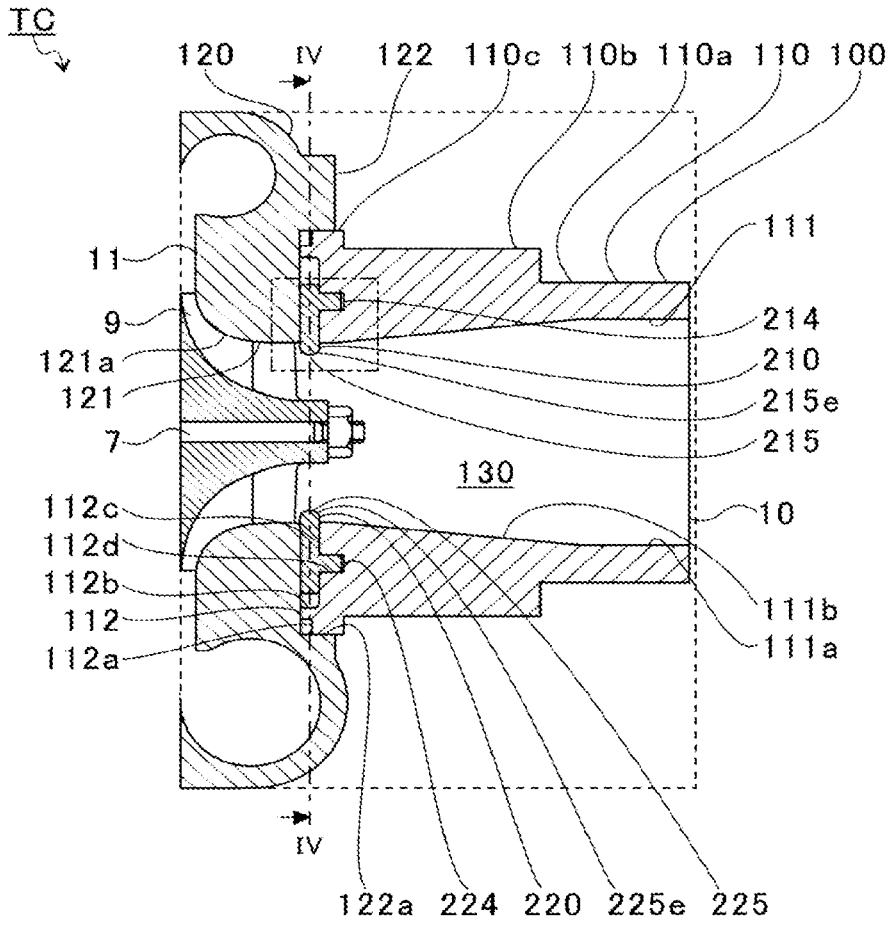
FIG. 2 is a diagram of a broken line part extracted from FIG. 1.

FIG. 2 is a diagram of a broken line part extracted from FIG. 1. In FIG. 2, the compressor impeller 9, the compressor housing 100, and a throttle member described later are extracted and illustrated. As illustrated in FIG. 2, the first housing member 110 of the compressor housing 100 is positioned on the right side (side away from the bearing housing 2) in FIG. 2 with respect to the second housing member 120.

The first housing member 110 has a substantially cylindrical shape. The first housing member 110 includes a small diameter portion 110*a*, a medium diameter portion 110*b*, and a large diameter portion 110*c*. The small diameter portion 110*a* is the farthest from the bearing housing 2. The large diameter portion 110*c* is the closest to the bearing housing 2. The medium diameter portion 110*b* is positioned between the small diameter portion 110*a* and the large diameter portion 110*c*. The small diameter portion 110*a* has a smaller outer diameter than that of the medium diameter portion 110*b*. The medium diameter portion 110*b* has a smaller outer diameter than that of the large diameter portion 110*c*. However, the first housing member 110 may not include the small diameter portion 110*a*, the medium diameter portion

110*b*, or the large diameter portion 110*c*. For example, the outer diameter may be approximately constant in the rotation axis direction.

A through hole 111 is formed in the first housing member 110. The through hole 111 penetrates through the first housing member 110 in the rotation axis direction of the compressor impeller 9 (hereinafter, simply referred to as the rotation axis direction, which is the axial direction of the shaft 7 and the left-right direction of the turbocharger TC). The through hole 111 penetrates through the small diameter portion 110*a*, the medium diameter portion 110*b*, and the large diameter portion 110*c* in the rotation axis direction. One end of the through hole 111 is the intake port 10 described above.

The through hole 111 includes a parallel portion 111*a* and a shrinking diameter portion 111*b*. The parallel portion 111*a* is positioned closer to the one end of the through hole 111 than the shrinking diameter portion 111*b* is. One end of the parallel portion 111*a* is the intake port 10. The inner diameter of the parallel portion 111*a* is approximately constant in the axial direction. One end of the shrinking diameter portion 111*b* is continuous with the parallel portion 111*a*. The inner diameter of the one end of the shrinking diameter portion 111*b* is approximately equal to the inner diameter of the parallel portion 111*a*. The inner diameter of the shrinking diameter portion 111*b* becomes smaller as the shrinking diameter portion 111*b* extends away from the parallel portion 111*a* (as approaches the second housing member 120).

In the first housing member 110, a cutout portion 112*a* is formed on the outer circumference of the end surface 112 on the second housing member 120 side. The cutout portion 112*a* is, for example, annular.

An accommodation groove 112*b* is formed on the end surface 112 of the first housing member 110. The accommodation groove 112*b* is recessed toward the intake port 10 side (side away from the second housing member 120) with respect to the end surface 112. The accommodation groove 112*b* has, for example, a substantially annular shape when viewed in the axial direction. In other words, the accommodation groove 112*b* is recessed outward in the radial direction with respect to the inner wall of the through hole 111.

In the accommodation groove 112*b*, bearing holes 112*d* are formed on a wall surface 112*c* that is on the intake port 10 side (small diameter portion 110*a* side, side away from the second housing member 120). The bearing holes 112*d* extend from the wall surface 112*c* toward the intake port 10 side in parallel to the rotation axis direction. Two bearing holes 112*d* are formed separately in the rotation direction of the compressor impeller 9 (hereinafter, simply referred to as the rotation direction). The two bearing holes 112*d* are arranged at positions shifted by 180 degrees in the rotation direction.

A through hole 121 is formed in the second housing member 120. The through hole 121 penetrates through the second housing member 120 in the rotation axis direction. The inner diameter of an end of the through hole 121 on the first housing member 110 side is approximately equal to the inner diameter of an end of the through hole 111 on the second housing member 120 side. A shroud portion 121*a* is formed on the inner wall of the through hole 121 of the second housing member 120. The shroud portion 121*a* faces the compressor impeller 9 from the outer side in the radial direction. The inner diameter of the shroud portion 121*a* increases as the shroud portion 121*a* extends away from the first housing member 110. An end of the shroud portion 121*a* that is on the opposite side to the first housing member 110 communicates with the diffuser flow passage 11 described above.

An accommodation groove 122*a* is formed on an end surface 122 of the second housing member 120 on the first housing member 110 side. The accommodation groove 122*a* is recessed toward the diffuser flow passage 11 side (side away from the first housing member 110) with respect to the end surface 122. The accommodation groove 122*a* has, for example, a substantially annular shape when viewed in the axial direction. In other words, the accommodation groove 122*a* is recessed outward in the radial direction with respect to the inner wall of the through hole 121. The large diameter portion 110*c* is inserted into the accommodation groove 122*a*. The end surface 112 of the first housing member 110 is in contact with a wall surface of the accommodation groove 122*a* on the diffuser flow passage 11 side.

An intake passage 130 is formed by the through hole 111 of the first housing member 110 and the through hole 121 of the second housing member 120. The intake passage 130 connects the intake port 10 and the diffuser flow passage 11 to each other. The compressor impeller 9 is provided in the intake passage 130. The cross-sectional shape of the intake passage 130 (through holes 111 and 121) orthogonal to the rotation axis direction is, for example, a circle centered on the rotation axis of the compressor impeller 9. However, the cross-sectional shape of the intake passage 130 is not limited thereto. A sealing material (not illustrated) is arranged in the cutout portion 112*a* of the first housing member 110. The sealing material curbs the flow rate of the air flowing through a gap between the first housing member 110 and the second housing member 120. However, the cutout portion 112*a* and the sealing material are not essential.

Figure 3:
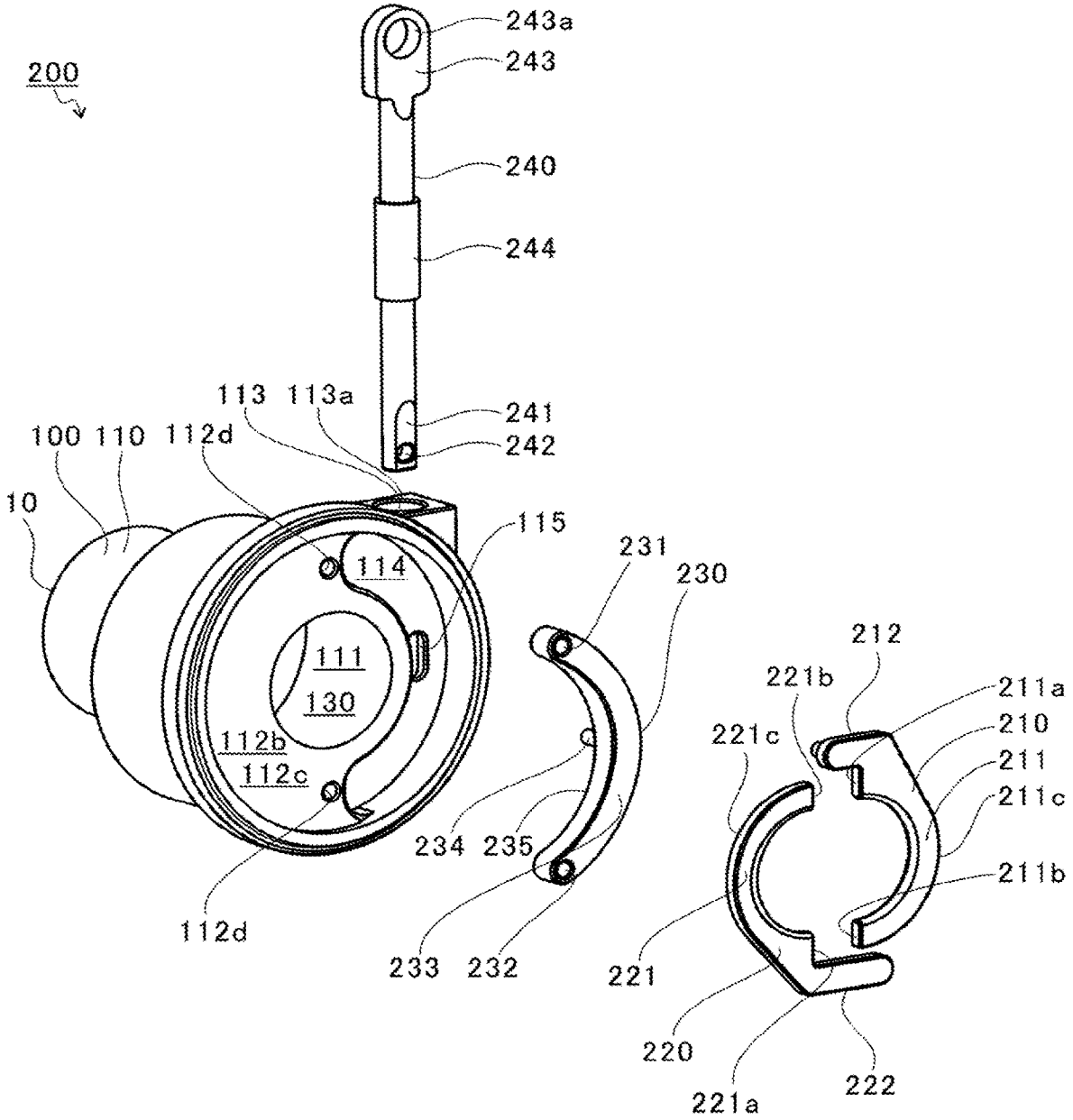
FIG. 3 is an exploded perspective view of members included in a link mechanism.

FIG. 3 is an exploded perspective view of members included in a link mechanism 200. In FIG. 3, only the first housing member 110 of the compressor housing 100 is illustrated. As illustrated in FIG. 3, the link mechanism 200 includes a compressor housing 100, a first throttle member 210, a second throttle member 220, a connection member 230, and a rod 240.

The first throttle member 210 includes a curved portion 211. The curved portion 211 has a substantially arc shape. A one end surface 211*a* and another end surface 211*b* of the curved portion 211 in the rotation direction extend parallel to the radial direction and the rotation axis direction. However, the one end surface 211*a* and the other end surface 211*b* may be inclined with respect to the radial direction and the rotation axis direction.

An arm portion 212 is provided on the one end surface 211*a* side of the curved portion 211. The arm portion 212 extends outward in the radial direction with respect to an outer curved surface 211*c* of the curved portion 211. The arm portion 212 extends in a direction inclined with respect to the radial direction (toward the second throttle member 220).

The second throttle member 220 includes a curved portion 221. The curved portion 221 has a substantial arc shape. A one end surface 221*a* and another end surface 221*b* of the curved portion 221 in the rotation direction extend parallel to the radial direction and the rotation axis direction. However, the one end surface 221*a* and the other end surface 221*b* may be inclined with respect to the radial direction and the rotation axis direction.

An arm portion 222 is provided on the one end surface 221*a* side of the curved portion 221. The arm portion 222 extends outward in the radial direction with respect to an outer curved surface 221*c* of the curved portion 221. The arm portion 222 extends in a direction inclined with respect to the radial direction (toward the first throttle member 210).

The curved portion 211 and the curved portion 221 face each other across the rotation center of the compressor impeller 9 (intake passage 130). The one end surface 211*a* of the curved portion 211 and the other end surface 221*b* of the curved portion 221 face each other. The other end surface 211*b* of the curved portion 211 and the one end surface 221*a* of the curved portion 221 face each other.

The connection member 230 is positioned closer to the intake port 10 side than the first throttle member 210 and the second throttle member 220. The connection member 230 has a substantially arc shape. Bearing holes 231 and 232 are formed on one end side and another end side of the connection member 230 in the rotation direction. The bearing holes 231 and 232 open to an end surface 233 of the connection member 230 on the side of the first throttle member 210 and the second throttle member 220. The bearing holes 231 and 232 extend in the rotation axis direction. Here, the bearing holes 231 and 232 are not through-holes. However, the bearing holes 231 and 232 may penetrate the connection member 230 in the rotation axis direction.

A rod connection portion 234 is included in the connection member 230 between the bearing holes 231 and 232. The rod connection portion 234 is included on an end surface 235 of the connection member 230 opposite to the first throttle member 210 and the second throttle member 220. The rod connection portion 234 projects from the end surface 235 in the rotation axis direction. The rod connection portion 234 has, for example, a substantially cylindrical shape.

The rod 240 has a substantially cylindrical shape. A flat surface portion 241 is formed at one end of the rod 240. The flat surface portion 241 extends in a planar direction substantially orthogonal to the rotation axis direction. A bearing hole 242 opens in the flat surface portion 241. The bearing hole 242 extends in the rotation axis direction. A connection portion 243 is provided at another end of the rod 240. The connection portion 243 includes a connecting hole 243*a*. An actuator described later is connected to the connection portion 243. The bearing hole 242 may be, for example, an elongated hole that is longer in a direction perpendicular to the rotation axis direction and the axial direction of the rod 240 (left-right direction in FIG. 5 described later) than in the axial direction of the rod 240.

A rod large diameter portion 244 is formed in the rod 240 between the flat surface portion 241 and the connection portion 243. The outer diameter of the rod large diameter portion 244 is larger than that of the portions of the rod 240 that are each continuous from the rod large diameter portion 244 to the flat surface portion 241 side and the connection portion 243 side.

An insertion hole 113 is formed in the first housing member 110. One end 113*a* of the insertion hole 113 opens to the outside of the first housing member 110. The insertion hole 113 extends, for example, in a planar direction orthogonal to the rotation axis direction. The insertion hole 113 is positioned on the outer side in the radial direction with respect to the through hole 111 (intake passage 130). The flat surface portion 241 side of the rod 240 is inserted into the insertion hole 113. The rod large diameter portion 244 is guided by the inner wall surface of the insertion hole 113 of the first housing member 110. Therefore, movement of the rod 240 in directions other than the central axis direction of the insertion hole 113 (central axis direction of the rod 240) is restricted.

An accommodation hole 114 is formed in the first housing member 110. The accommodation hole 114 opens to the wall surface 112*c* of the accommodation groove 112*b*. The accommodation hole 114 is recessed from the wall surface 112*c* toward the intake port 10 side (side away from the second housing member 120). The accommodation hole 114 has a substantially arc shape when viewed from the rotation axis direction. On the wall surface 112*c*, the accommodation hole 114 extends longer than the connection member 230 in the rotation direction. Both ends of the accommodation hole 114 in the rotation direction are separated from the bearing holes 231 and 232 in the rotation direction. The accommodation hole 114 is positioned closer to the second housing member 120 side (first throttle member 210 side) than the insertion hole 113 is.

A communication hole 115 is formed in the first housing member 110. The communication hole 115 connects the insertion hole 113 with the accommodation hole 114. The communication hole 115 is formed in the accommodation hole 114 in an approximately middle portion in the rotation direction. The communication hole 115 extends substantially parallel to the extending direction of the insertion hole 113. The width of the communication hole 115 in a planar direction orthogonal to the extending direction of the insertion hole 113 and the rotation axis direction is larger than the outer diameter of the rod connection portion 234 of the connection member 230. The communication hole 115 is an elongated hole in which the width in the extending direction of the insertion hole 113 is larger than the width in a planar direction orthogonal to the extending direction of the insertion hole 113 and the rotation axis direction.

The connection member 230 is accommodated in the accommodation hole 114. The accommodation hole 114 has a longer length in the rotation direction and a larger width in the radial direction than those of the connection member 230. Therefore, the connection member 230 is allowed to move in the planar direction (longitudinal direction of the communication hole 115) orthogonal to the rotation axis direction inside the accommodation hole 114.

The rod connection portion 234 is inserted from the communication hole 115 into the insertion hole 113. The bearing hole 242 of the rod 240 inserted into the insertion hole 113 faces the communication hole 115. The rod connection portion 234 is inserted into (connected to) the bearing hole 242. The rod connection portion 234 is pivotally supported by the bearing hole 242.

Figure 4:
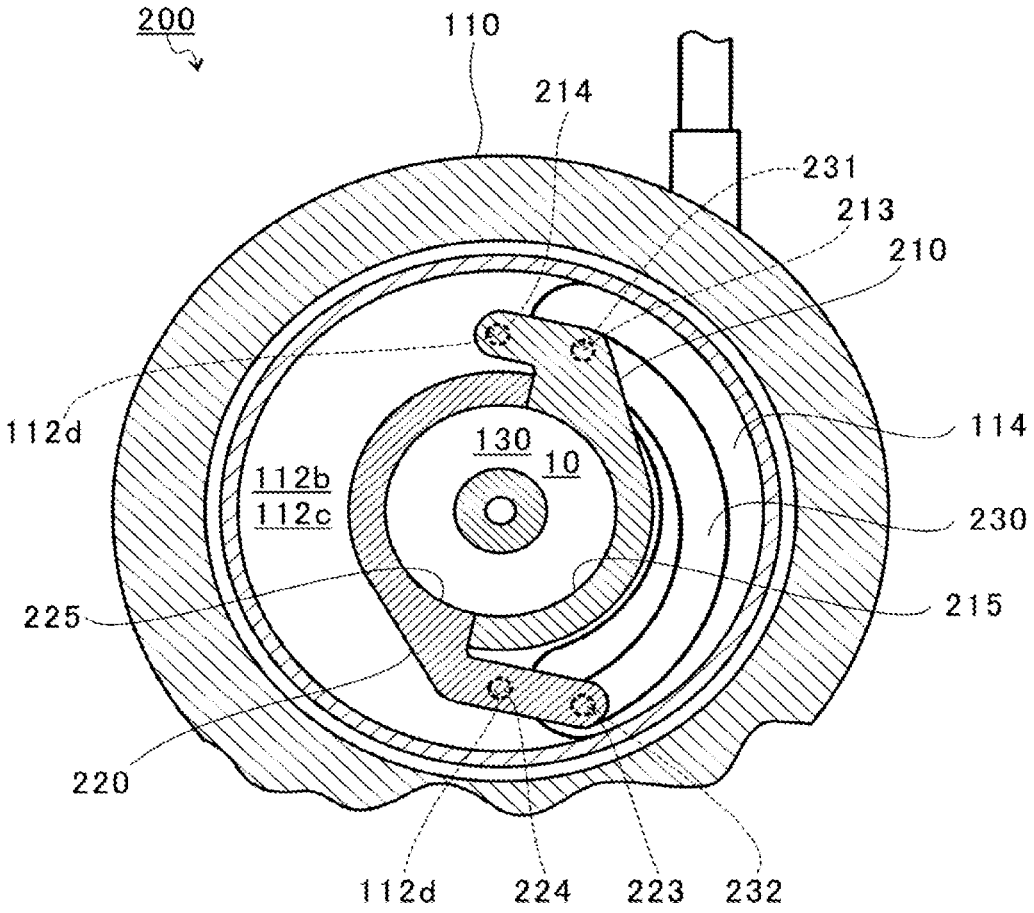
FIG. 4 is a sectional view taken along line IV-IV in FIG. 2.

FIG. 4 is a sectional view taken along line IV-IV in FIG. 2. As illustrated by broken lines in FIG. 4, the first throttle member 210 includes a connection shaft 213 and a rotation shaft 214. The connection shaft 213 and the rotation shaft 214 project in the rotation axis direction from the end surface of the first throttle member 210 on the intake port 10 side (wall surface 112*c* side of the accommodation groove 112*b*). The connection shaft 213 and the rotation shaft 214 extend toward the back side of the paper in FIG. 4. The rotation shaft 214 extends parallel to the connection shaft 213.

The outer diameter of the connection shaft 213 is smaller than the inner diameter of the bearing hole 231 of the connection member 230. The connection shaft 213 is inserted into the bearing hole 231. The connection shaft 213 is pivotally supported by the bearing hole 231. The outer diameter of the rotation shaft 214 is smaller than the inner diameter of the bearing holes 112*d* of the first housing member 110. The rotation shaft 214 is inserted into one of the bearing holes 112*d*. The rotation shaft 214 is pivotally supported by the bearing hole 112*d* (see FIG. 2). That is, the rotation shaft 214 connects the first throttle member 210 and the wall surface 112*c* facing the first throttle member 210 in the rotation axis direction.

The second throttle member 220 includes a connection shaft 223 and a rotation shaft 224. The connection shaft 223 and the rotation shaft 224 project in the rotation axis direction from the end surface of the second throttle member 220 on the intake port 10 side (wall surface 112*c* side of the accommodation groove 112*b*). The connection shaft 223 and the rotation shaft 224 extend toward the back side of the paper in FIG. 4. The rotation shaft 224 extends parallel to the connection shaft 223.

The outer diameter of the connection shaft 223 is smaller than the inner diameter of the bearing hole 232 of the connection member 230. The connection shaft 223 is inserted into the bearing hole 232. The connection shaft 223 is pivotally supported by the bearing hole 232. The outer diameter of the rotation shaft 224 is smaller than the inner diameter of the bearing hole 112*d*. The rotation shaft 224 is inserted into the other bearing hole 112*d*. The rotation shaft 224 is pivotally supported by the bearing hole 112*d* (see FIG. 2). That is, the rotation shaft 224 connects the second throttle member 220 and the wall surface 112*c* facing the second throttle member 220 in the rotation axis direction.

In this manner, the link mechanism 200 is a four-link mechanism. The four links are the first throttle member 210, the second throttle member 220, the first housing member 110, and the connection member 230. Since the link mechanism 200 is the four-link mechanism, it is a limited chain, has one-degree-of-freedom, and is easy to control.

Figure 5:
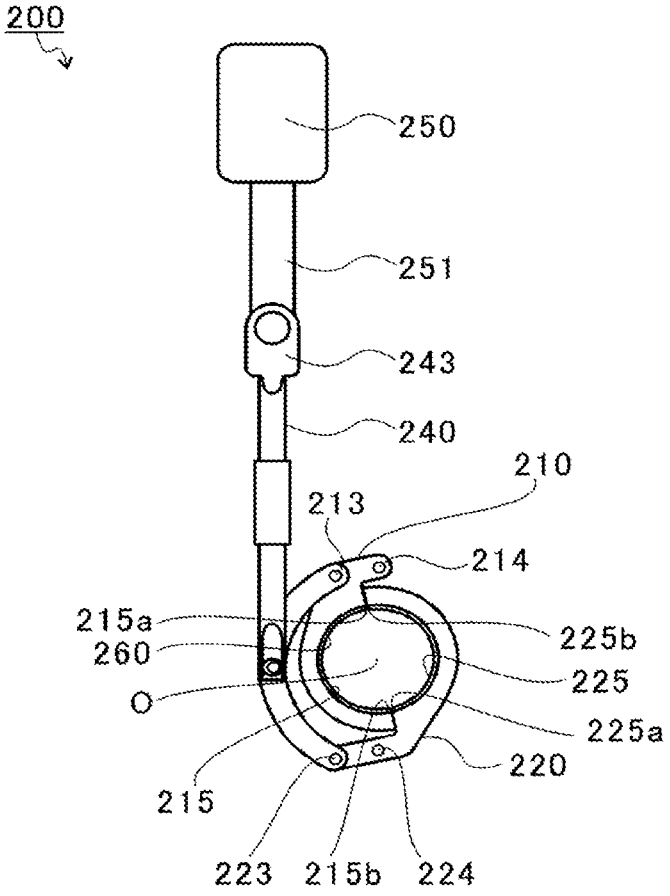
FIG. 5 is a first diagram for explaining the operation of the link mechanism.
Figure 6:
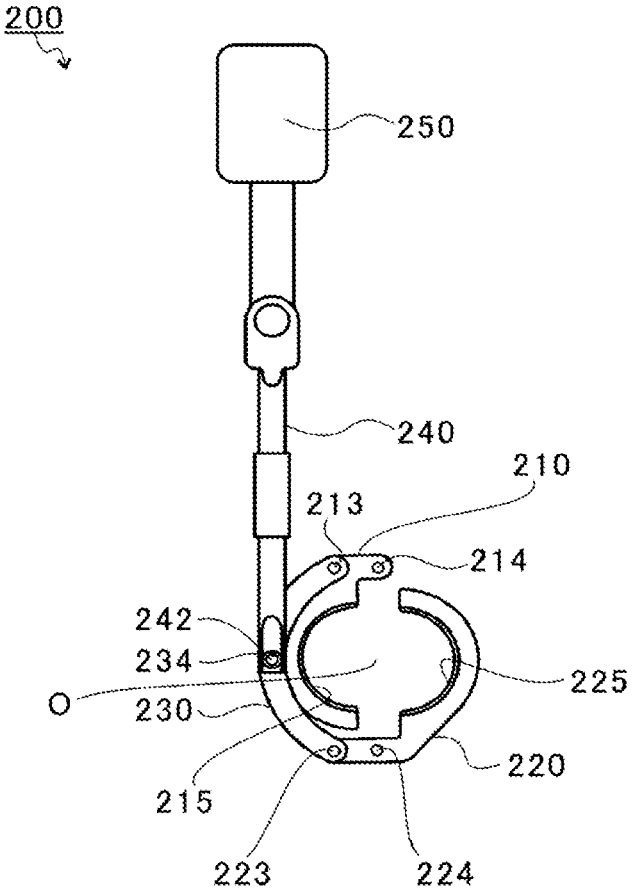
FIG. 6 is a second diagram for explaining the operation of the link mechanism.
Figure 7:
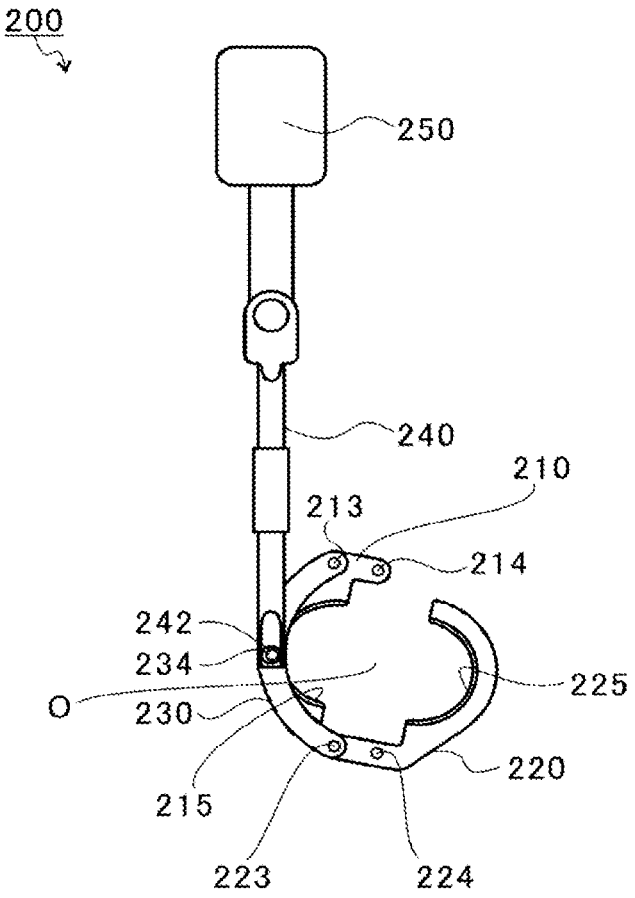
FIG. 7 is a third diagram for explaining the operation of the link mechanism.

FIG. 5 is a first diagram for explaining the operation of the link mechanism 200. In FIGS. 5, 6, and 7 below, diagrams viewed from the intake port 10 side are illustrated. As illustrated in FIG. 5, one end of a driving shaft 251 of an actuator 250 is connected to the connection portion 243 of the rod 240.

In the arrangement illustrated in FIG. 5, the first throttle member 210 and the second throttle member 220 are in contact with each other. Here, as illustrated in FIGS. 2 and 4, a protruding portion 215, which is a portion of the first throttle member 210 on an inner side in the radial direction, protrudes into the intake passage 130. A protruding portion 225, which is a portion of the second throttle member 220 on an inner side in the radial direction, protrudes into the intake passage 130. The positions of the first throttle member 210 and the second throttle member 220 here are called a throttle position.

At the throttle position, ends 215*a* and 215*b* of the protruding portion 215 in the rotation direction and ends 225*a* and 225*b* of the protruding portion 225 in the rotation direction are in contact with each other. The protruding portions 215 and 225 form an annular hole 260. The inner diameter of the annular hole 260 is smaller than the inner diameter of the portion of the intake passage 130 where the first throttle member 210 and the second throttle member 220 are provided. The inner diameter of the annular hole 260 is, for example, smaller than the smallest inner diameter of the intake passage 130.

FIG. 6 is a second diagram for explaining the operation of the link mechanism 200. FIG. 7 is a third diagram for explaining the operation of the link mechanism 200. The actuator 250 causes the rod 240 to linearly move in a direction intersecting with the rotation axis direction (up-down direction in FIGS. 6 and 7). The rod 240 moves upward from the state illustrated in FIG. 5. The arrangement of FIG. 7 has a larger amount of movement of the rod 240 than that of the arrangement of FIG. 6 with respect to the arrangement of FIG. 5.

When the rod 240 moves, the connection member 230 also moves upward in FIGS. 6 and 7 via the rod connection portion 234. At this point, the connection member 230 is allowed to rotate about the rod connection portion 234 as a rotation center. There is a slight play in the inner diameter of the bearing hole 242 of the rod 240 with respect to the outer diameter of the rod connection portion 234. Therefore, the connection member 230 is allowed to slightly move in a planar direction orthogonal to the rotation axis direction.

As described above, the link mechanism 200 has a four-link mechanism. The connection member 230, the first throttle member 210, and the second throttle member 220 behave in one-degree-of-freedom with respect to the first housing member 110. Specifically, the connection member 230 slightly swings in the left-right direction while slightly rotating counterclockwise in FIGS. 6 and 7 within the above allowable range.

Since the rotation shaft 214 of the first throttle member 210 is pivotally supported by the first housing member 110, the movement in the planar direction orthogonal to the rotation axis direction is restricted. The connection shaft 213 is pivotally supported by the connection member 230. Since the movement of the connection member 230 is allowed, the connection shaft 213 is provided so as to be movable in a planar direction orthogonal to the rotation axis direction. With the movement of the connection member 230, the first throttle member 210 rotates in a clockwise direction in FIGS. 6 and 7 about the rotation shaft 214 as the rotation center.

Since the rotation shaft 224 of the second throttle member 220 is pivotally supported by the first housing member 110, the movement in the planar direction orthogonal to the rotation axis direction is restricted. The connection shaft 223 is pivotally supported by the connection member 230. Since the movement of the connection member 230 is allowed, the connection shaft 223 is provided so as to be movable in a planar direction orthogonal to the rotation axis direction. As a result, with the movement of the connection member 230, the second throttle member 220 rotates about the rotation shaft 224 as the rotation center in a clockwise direction in FIGS. 6 and 7.

In this manner, the first throttle member 210 and the second throttle member 220 move in directions away from each other in the order of FIGS. 6 and 7. The protruding portions 215 and 225 move outward in the radial direction (retracted position), with respect to the throttle position. In the retracted position, for example, the protruding portions 215 and 225 are flush with the inner wall surface of the intake passage 130 or are positioned on an outer side in the radial direction with respect to the inner wall surface of the intake passage 130. Upon shift from the retracted position to the throttle position, the first throttle member 210 and the second throttle member 220 approach and abut against each other in the order of FIGS. 7, 6, and 5. The first throttle member 210 and the second throttle member 220 switch between the throttle position and the retracted position depending on the rotation angles about the rotation shafts 214 and 224, respectively, as the rotation centers.

In this manner, the first throttle member 210 and the second throttle member 220 can be moved between the throttle position and the retracted position. According to the link mechanism 200, it is possible to simplify the structure for changing the flow passage cross-sectional area of the intake passage 130.

The rod connection portion 234 is arranged at a position away from the rotation shaft 214 than from the connection shaft 213. The connection member 230 extends from the rod connection portion 234 toward the rotation shaft 214 side. The connection shaft 213 is positioned between the rod connection portion 234 and the rotation shaft 214. As a result, the distance between the rotation shaft 214 and the connection shaft 213 is short. Therefore, even a slight movement of the connection shaft 213 results in a large rotation angle of the first throttle member 210. That is, the movement amount of the actuator 250 required for rotation of the same rotation angle can be small. As a result, the actuator 250 can be downsized.

The rod connection portion 234 is arranged at a position away from the rotation shaft 224 than from the connection shaft 223. The connection member 230 extends from the rod connection portion 234 toward the rotation shaft 224 side. The connection shaft 223 is positioned between the rod connection portion 234 and the rotation shaft 224. Therefore, the actuator 250 can be downsized as in the above explanation regarding the first throttle member 210.

As illustrated in FIGS. 5, 6, and 7, a rotation center O of the compressor impeller 9 is positioned in the middle of the rotation shaft 214 and the rotation shaft 224. The protruding portion 215 and the protruding portion 225 move in loci that are point-symmetric about the rotation center O. The distance between the connection shaft 213 and the rotation shaft 214 is approximately equal to the distance between the connection shaft 223 and the rotation shaft 224. Therefore, the rotation angles of the first throttle member 210 and the second throttle member 220 are approximately equal. The protruding portions 215 and 225 are arranged point-symmetrically with respect to the rotation center O at any rotation angle. That is, the protrusion amounts into the intake passage 130 are equal to each other. The protruding portions 215 and 225 are unlikely to disturb the flow of intake air.

Figure 8:
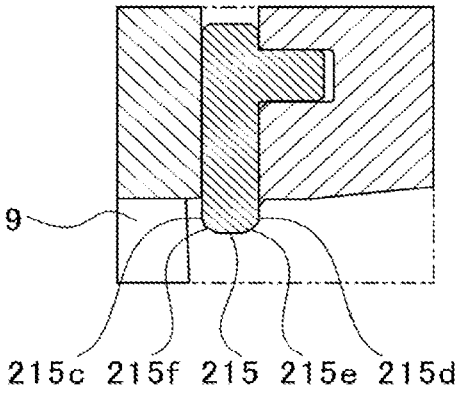
FIG. 8 is a diagram of a two-dot chain line part extracted from FIG. 2.

FIG. 8 is a diagram of a two-dot chain line part extracted from FIG. 2. As illustrated in FIG. 8, the protruding portion 215 has a counterpart surface 215*c* facing the compressor impeller 9. An upstream surface 215*d* facing the intake port 10 is formed on the opposite side of the counterpart surface 215*c* in the protruding portion 215. A tapered portion 215*e* is formed at an end on the inner side in the radial direction in the upstream surface 215*d*. The distance from the tapered portion 215*e* to the counterpart surface 215*c* becomes shorter as the tapered portion 215*e* extends inward in the radial direction. The tapered portion 215*e* extends away from the intake port 10 as the tapered portion 215*e* extends inward in the radial direction. In the tapered portion 215*e*, the cross-sectional shape including the rotation axis of the compressor impeller 9 (hereinafter, simply referred to as a cross-sectional shape) is curved as illustrated in FIG. 8. However, the cross-sectional shape of the tapered portion 215*e* may be linear.

A tapered portion 215*f* is also formed on the counterpart surface 215*c* of the protruding portion 215. However, the tapered portion 215*f* is not essential. The tapered portion 215*e* may extend to the counterpart surface 215*c*. Although the tapered portion 215*e* of the protruding portion 215 has been described in detail here, a tapered portion 225*e* is also formed in the protruding portion 225 (see FIG. 2).

Figure 9:
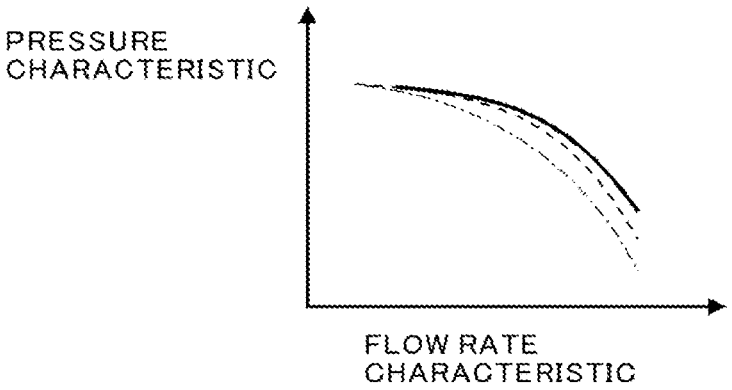
FIG. 9 is a graph for explaining the effect of tapered portions.

FIG. 9 is a graph for explaining the effect of the tapered portions 215*e* and 225*e*. In FIG. 9, the horizontal axis represents the flow rate characteristics of the centrifugal compressor C, and represents that the flow rate is larger on the right side. The vertical axis represents the pressure characteristics of the centrifugal compressor C, and represents that the compression ratio is larger on the upper side. In FIG. 9, an example indicated by a solid line represents a state in which the protruding portions 215 and 225 do not protrude into the intake passage 130 (retracted position). In FIG. 9, and example indicated by a broken line represents a case where the protruding portions 215 and 225 are at the throttle position and the protruding portions 215 and 225 have tapered portions 215*e* and 225*e*. In FIG. 9, an example indicated by a one-dot chain line represents a comparative example in which the protruding portions 215 and 225 are at the throttle position and the protruding portions 215 and 225 are not formed with the tapered portions 215*e* and 225*e*.

As illustrated in FIG. 9, by moving the protruding portions 215 and 225 to the throttle position, the operating area on the small flow rate side is expanded. On the large flow rate side, the compression ratio can be increased when the protruding portions 215 and 225 do not protrude into the intake passage 130 as the example of the solid line shows. Therefore, on the large flow rate side, the protruding portions 215 and 225 do not protrude into the intake passage 130.

Let us assume that a transition from the large flow rate side to the small flow rate side has occurred and that, for example, data such as pressure characteristics acquired from a sensor (not illustrated) satisfies a predetermined condition. A control unit (not illustrated) (e.g. ECU) controls the actuator 250 to move the protruding portions 215 and 225 to the throttle position. At this point, in a case where the pressure characteristics with respect to the same flow rate characteristics vary significantly after the movement of the protruding portions 215 and 225 as compared to those before the movement, the pressure during the intake fluctuates significantly. Therefore, it is desirable to move the protruding portions 215 and 225 to the throttle position within the range of flow rate characteristics that overlap with the example of the solid line.

The example of the one-dot chain line has a smaller overlapping area with the example of the solid line. On the other hand, the example of the broken line has a larger overlapping area with the example of the solid line. That is, by forming the tapered portions 215*e* and 225*e* in the protruding portions 215 and 225, it becomes easier to perform control with curbed pressure fluctuation during the intake.

Although the embodiment of the present disclosure has been described with reference to the accompanying drawings, it is understood that the present disclosure is not limited to the above embodiment. It is obvious that a person skilled in the art can conceive of various modifications or variations within the scope described in the claims, and it is understood that they are also within the technical scope of the present disclosure.

For example, in the above-described embodiment, the case where the centrifugal compressor C is incorporated into the turbocharger TC has been described. However, the centrifugal compressor C may be incorporated in a device other than the turbocharger TC or may be a separate device.

In the above-described embodiment, the case where the first throttle member 210 and the second throttle member 220 are included as throttle members has been described. However, it is only required that at least one of the first throttle member 210 or the second throttle member 220 be included. Also, three or more throttle members may be included.

In the above-described embodiment, the case where the link mechanism 200 has the four-link mechanism has been described. However, the link mechanism 200 may not have a four-link mechanism. For example, the link mechanism 200 may have a five-link mechanism.

In the above-described embodiment, the case where both ends 215*a*, 215*b*, 225*a*, and 225*b* of the protruding portions 215 and 225 of both the first throttle member 210 and the second throttle member 220 contact with each other to form the annular hole 260 has been described. For example, in a case where an annular hole 260 having an inner diameter smaller than the inner diameter of the intake passage 130 is formed by three or more throttle members, the number of boundaries between the throttle members is three or more. In addition, as the number of throttle members increases, it becomes more difficult to move all the throttle members in complete conjunction. Since the number of boundaries is large and it is difficult to interlock, there is a high possibility that the boundaries will shift. By forming the annular hole 260 by the first throttle member 210 and the second throttle member 220, the number of boundaries is minimized (two). The number of interlocked members is also minimized. It is unlikely that the boundaries shift. Therefore, it becomes possible to bring the annular hole 260 closer to a perfect circle. However, the annular hole 260 may be formed by the first throttle member 210, the second throttle member 220, and other members.

In the above-described embodiment, the case has been described in which the rotation center O of the compressor impeller 9 is positioned in the middle of the rotation shafts 214 and 224. However, the rotation center O of the compressor impeller 9 may be shifted from the middle of the rotation shafts 214 and 224.

In the embodiment described above, the case has been described in which the rotation shafts 214 and 224 connect the first throttle member 210, the second throttle member 220, and the wall surface 112*c*, and the movement in the planar direction orthogonal to the rotation axis direction is restricted. The case has been described in which the connection shafts 213 and 223 are provided so as to be movable in the planar direction orthogonal to the rotation axis direction. In this case, the movement of the rotation shafts 214 and 224 other than the rotation is restricted, and thus the structure can be simplified. However, the rotation shafts 214 and 224 may also be movable in the planar direction orthogonal to the rotation axis direction like the connection shafts 213 and 223. In this case, for example, a groove for restricting the movement of the rotation shafts 214 and 224 to a single direction may be formed in the compressor housing 100.

In the above-described embodiment, the case has been described in which the rod connection portion 234 is provided at a position in the connection member 230 that is on the outer side in the radial direction with respect to the intake passage 130 and is farther from the rotation shafts 214 and 224 than from the connection shafts 213 and 223. However, the rod connection portion 234 may be positioned closer to the rotation shaft 214 (rotation shaft 224) than to the connection shaft 213 (connection shaft 223). The distance between the rod connection portion 234 and the rotation shaft 214 (rotation shaft 224) may be equal to the distance between the connection shaft 213 (connection shaft 223) and the rotation shaft 214 (rotation shaft 224).

In the above-described embodiment, the case where the tapered portions 215*e* and 225*e* are formed in the protruding portions 215 and 225 has been described. However, the tapered portions 215*e* and 225*e* are not essential.

INDUSTRIAL APPLICABILITY

The present disclosure is applicable to a centrifugal compressor and a turbocharger.

What is claimed is:

1. A centrifugal compressor comprising:

a compressor housing in which an intake passage is formed;

a compressor impeller provided in the intake passage;

an actuator that causes a rod to linearly move in a direction orthogonal with a rotation axis direction of the compressor impeller;

a connection member connected to the rod, the connection member presenting an arcuate shape;

a throttle member including a protruding portion;

a connection shaft extending in the rotation axis direction and connecting the connection member and the throttle member; and a rotation shaft extending in a direction parallel to the connection shaft and serving as a rotation center of the throttle member, wherein the throttle member comprises a first throttle member and a second throttle member, wherein the connection shaft and the rotation shaft are provided to each of the first throttle member and the second throttle member, and wherein both ends of the protruding portions of both the first throttle member and the second throttle member are in contact with each other and form an annular hole having an inner diameter smaller than that of the intake passage.

2. The centrifugal compressor according to claim 1, wherein the throttle member is switched between a throttle position, at which the protruding portion protrudes into the intake passage, and a retracted position, at which the protruding portion is positioned on an outer side in a radial direction of the compressor impeller with respect to the throttle position, depending on a rotation angle with the rotation shaft as a rotation center.

3. The centrifugal compressor according to claim 1, wherein the compressor housing, the connection member, the first throttle member, and the second throttle member are comprised in a four-link mechanism.

4. The centrifugal compressor according to claim 3, wherein a rotation center of the compressor impeller is positioned in a middle of the two rotation shafts provided to the first throttle member and the second throttle member.

5. The centrifugal compressor according to claim 1, wherein a rotation center of the compressor impeller is positioned in a middle of the two rotation shafts provided to the first throttle member and the second throttle member.

6. The centrifugal compressor according to claim 1, wherein the rotation shaft connects the throttle member and a wall surface of the compressor housing facing the throttle member in the rotation axis direction, and is restricted from movement in a planar direction orthogonal to the rotation axis direction, and the connection shaft is provided so as to be movable in the planar direction orthogonal to the rotation axis direction.

7. The centrifugal compressor according to claim 1, wherein the connection member is provided with a rod connection portion connected to the rod at a position outer side in a radial direction of the compressor impeller with respect to the intake passage and farther from the rotation shaft than the connection shaft.

8. The centrifugal compressor according to claim 1, wherein a tapered portion is formed in the protruding portion on a side opposite to a counterpart surface facing the compressor impeller, the tapered portion having a distance to the counterpart surface that decreases as closer to an inner side in a radial direction of the compressor impeller.

9. A turbocharger comprising the centrifugal compressor according to claim 1.

* * * * *